US007345572B2

(12) United States Patent
Losbichler et al.

(10) Patent No.: US 7,345,572 B2
(45) Date of Patent: Mar. 18, 2008

(54) TEMPERATURE SENSOR

(75) Inventors: Paul Losbichler, Vienna (AT); Christian Auradnik, Klosterneuburg (AT)

(73) Assignee: Electrovac, Fabrikation elektrotechnischer Spezialartikel Ges.m.b.H., Klosterneuburg (AT)

( * ) Notice: Subject to any disclaimer, the term of this patent is extended or adjusted under 35 U.S.C. 154(b) by 314 days.

(21) Appl. No.: 11/065,328

(22) Filed: Feb. 24, 2005

(65) Prior Publication Data

US 2005/0184849 A1 Aug. 25, 2005

(30) Foreign Application Priority Data

Feb. 24, 2004 (EP) ..... 04004151

(51) Int. Cl.
*H01H 37/48* (2006.01)
*H01H 37/32* (2006.01)

(52) U.S. Cl. ..... 337/394; 337/393

(58) Field of Classification Search ..... 337/394, 337/393, 396

See application file for complete search history.

(56) References Cited

U.S. PATENT DOCUMENTS

| | | | | | |
|---|---|---|---|---|---|
| 3,004,123 | A | * | 10/1961 | Cannon | 337/393 |
| 3,004,132 | A | | 10/1961 | Cannon | |
| 3,029,329 | A | * | 4/1962 | Bolesky | 337/386 |
| 3,194,927 | A | * | 7/1965 | Place | 337/387 |
| 3,899,765 | A | * | 8/1975 | Daigneault, Jr. | 337/386 |
| 4,050,044 | A | | 9/1977 | Fischer et al. | |
| 4,544,831 | A | * | 10/1985 | Bayer | 219/445.1 |
| 4,901,049 | A | * | 2/1990 | Kicherer et al. | 337/394 |
| 5,420,398 | A | * | 5/1995 | Petri et al. | 219/505 |
| 5,627,507 | A | * | 5/1997 | Morbitzer et al. | 337/394 |
| 6,007,327 | A | * | 12/1999 | Morbitzer | 431/75 |
| 6,304,165 | B1 | | 10/2001 | Petri et al. | |
| 6,646,538 | B2 | * | 11/2003 | Morbitzer | 337/394 |
| 6,724,294 | B2 | * | 4/2004 | Morbitzer | 337/394 |
| 7,119,654 | B2 | * | 10/2006 | Losbichler | 337/394 |
| 2004/0178878 | A1 | * | 9/2004 | Losbichler | 337/394 |

FOREIGN PATENT DOCUMENTS

| | | |
|---|---|---|
| AT | 386 673 | 9/1988 |
| DE | 24 22 625 | 11/1975 |
| DE | 29 37 309 | 4/1981 |
| EP | 0 279 368 A | 8/1988 |
| EP | 0 818 796 | 1/1998 |
| EP | 0 898 291 | 2/1999 |
| EP | 0 901 310 A | 3/1999 |
| EP | 0 962 951 | 12/1999 |
| GB | 2 156 157 | 10/1985 |

* cited by examiner

*Primary Examiner*—Anatoly Vortman
(74) *Attorney, Agent, or Firm*—Henry M. Feiereisen

(57) ABSTRACT

A temperature sensor for a radiant heating element includes a first expansion element, e.g., a tube, connected to a housing of a switch, which is permanently connected to a second expansion element, e.g., a rod in the region of its free end. The two expansion elements have different thermal expansion coefficients, and the switch has at least one contact spring, which is pre-tensioned against a point and carries a contact. The contact spring is implemented as a snap spring. The first expansion element has a spring acting in its axial direction applied to it. To avoid rapid fatigue of the contact spring, the second expansion element acts on the contact spring on one side and the spring acting in the axial direction of the second expansion element acts on the contact spring on the other side, with the spring acting against the second expansion element via a support.

14 Claims, 4 Drawing Sheets

Fig. 6a
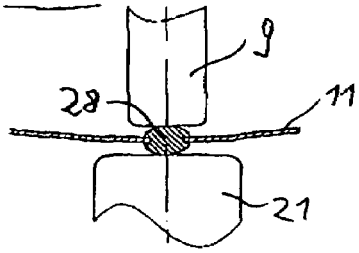
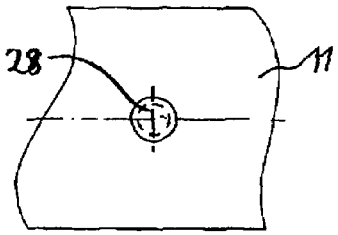
Fig. 6b
Fig. 7a
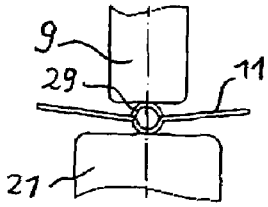
Fig. 7b
Section A-A
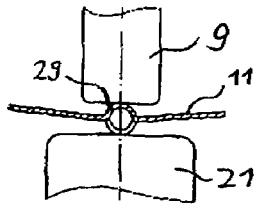
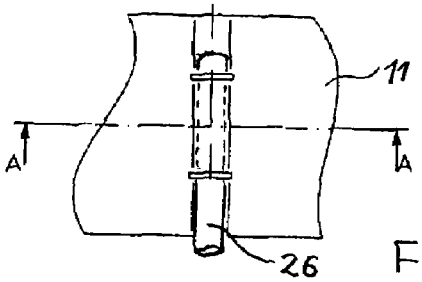
Fig. 7c
Fig. 8a
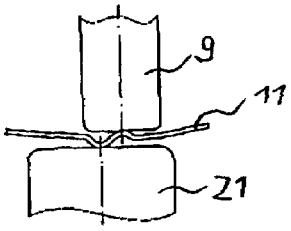
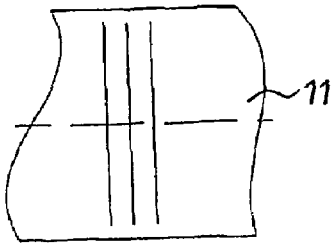
Fig. 8b
Fig. 9a
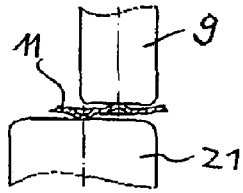
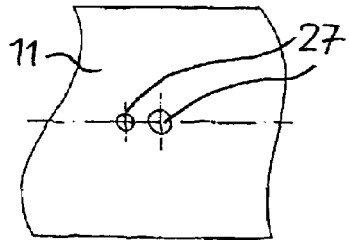
Fig. 9b

TEMPERATURE SENSOR

CROSS-REFERENCES TO RELATED APPLICATIONS

This application claims the priority of European Patent Application, Serial No. 04004151.9, filed Feb. 24, 2004, pursuant to 35 U.S.C. 119(a)-(d).

BACKGROUND OF THE INVENTION

The present invention relates to a temperature sensor for a radiant heating element, this temperature sensor having an expansion element, such as a tube, connected to a housing of a switch, which is permanently connected to a further expansion element, such as a rod, in the region of its free end, the two expansion elements having different thermal expansion coefficients, and the switch having at least one contact spring, pre-tensioned against a point and carrying a contact, which is implemented as a snap spring and a spring, which acts in its axial direction, being applied to one of the expansion elements.

Temperature sensors of this type are generally used, for example, where electrically or gas heated devices, such as hot plates, radiant heating elements of glass ceramic cooking elements, oven muffles, or the like are to be protected from overheating.

EP 279 368 describes a temperature sensor system corresponding to the related art. In this case, an external sensor tube having a higher thermal expansion coefficient is typically positioned with a rod positioned therein, which is connected to the tube at the free end and is axially displaceable in the sensor tube and has a lower thermal expansion coefficient. In this case, the active section of the temperature sensor corresponds to the length over which the tube and the internal rod are positioned one inside the other. The different thermal expansions of these two parts lead to a differential length when the temperature sensor is heated, which is used to switch the contact system. In such temperature sensors, the position of the axially movable internal rod to the switch system and/or the contact spring is determined by positioning and fixing an adjustment element and the switching temperature of the contact spring is thus given.

In a known temperature sensor of this type, if a temperature is applied to the sensor rod system in a radiant heating element, the contact spring is controlled indirectly by the rod using a plunger. The contact spring is rigidly connected to the spring bearing in the related art, with the aid of welding or riveting, for example. The contact spring is implemented as a snap spring. In the indirectly acting contact systems, the main thermal contact springs are self-closing, i.e., the contact system is closed when the indirectly acting plunger does not touch the contact spring. In the adjusted starting state, i.e., in the cold state, the pre-tension in the contact spring is at a minimum. With increasing temperature, the plunger acts with a specific actuation force on the contact spring, which is preferably implemented as wavy in the transmission region. A deflection of the contact spring is thus generated, through which the tension state of the flexible tongue, which is already pre-tensioned in the starting state, is elevated. The tension state in the spring is a maximum directly before the switching point. In operation, this results in a simultaneous occurrence of critical loads. These include both externally supplied temperature and the intrinsic heating of the spring because of the electrical load, as well as mechanical tensions, which leads to material fatigue of the contact spring and therefore to a short service life of the temperature regulator. Furthermore, this high load of the contact spring also leads to failure of the snap mechanism.

DE 2422625 describes a temperature limiter for electrical hot plates, the rod acting on directly on the snap element of the snap spring without transmission. This snap switch is restricted to a temperature range of 400° C. and additionally has a snap hysteresis loop of less than 2/100 mm. For adjustment, an adjustment screw is screwed into the external tube on its free end, on which the transmission rod is supported. The thread quality of the internal thread provided on the external tube may only be fixed within coarse tolerances because of the tube material, which is difficult to shape, this having the effect that the wear of the threading tool is very high and occurs rapidly. The poor thread quality relates above all to the thread flanks and the tolerance deviations of the thread core diameter.

AT 386 673 discloses a temperature limiter which is positioned between a gas burner element and a glass ceramic cooking surface heated thereby, the tube of the temperature sensor being enclosed by an envelope tube which surrounds it at a distance. In the contact system, a snap spring having an additional movable spring arm is attached, which carries a contact part on its end that ensures the mechanical contact between the ceramic rod and the actuation point of the snap spring. The system is restricted to a single-circuit regulator. Through an additional spring element between the ceramic rod and snap spring, which supports the axial motion of the sensor rod in the sensor tube when a temperature is applied to the temperature sensor or, if the pre-tension of the contact spring is too low, first allows this motion, in that the force acting because of the additional spring element in the axial rod direction overcomes the frictional forces between sensor rod and sensor tube, the precision of the switching temperature may be influenced negatively because of the shaping and position tolerances of this additional component. Through the position of this additional spring element between the contact spring and/or actuation rod, this current-carrying additional spring element is subjected to the externally supplied temperature load and to the temperature load caused by the contact spring because of the electrical load and also the temperature load because of its intrinsic heat as a result of the electrical load of the additional spring element.

With the simultaneous occurrence of the mechanical load required for the pre-tension of the additional spring element, these loads lead to the same damage picture which is to be observed in the contact spring.

The typical temperature regulation systems are designed for heaters having 1200 W to 2300 W peak load. The requirements for individual components, in the breaker head, for example, of such temperature sensors are becoming higher and higher in regard to switching precision and electrical and thermal load. If a hot plate is now operated at 3000 W and higher, the power P to be dissipated at the same voltage, according to the following formula:

$$P=I^2\times R,$$

wherein I indicates the current via the contact spring, and R indicates the resistance of the contact spring, increases with the square of the current.

The contact spring is thus strained to the carrying capacity and beyond, frequently repeated strains, such as cyclic strains, leading to irreversible material changes even if the mechanical tensions in the contact spring are below the yield strength. These appearances are referred to as fatigue. The fatigue appearances are essentially a function of the tension state of the material and of the thermal strain.

It would therefore be desirable and advantageous to provide an improved temperature sensor which obviates prior art shortcomings and in which rapid fatigue of the contact spring and an additional spring element that allows the axial motion of the internal rod in the sensor tube are avoided. Furthermore, the mechanical and/or thermal transmission in the region of the contact spring is to be optimized for the switching point precision of one or more contact systems.

SUMMARY OF THE INVENTION

According to one aspect of the present invention, a temperature sensor includes a switch having a housing and at least one contact spring which is pre-tensioned against a point and carries a contact, with the contact spring being implemented as a snap spring, a first expansion element connected to the housing of the switch, a second expansion element having a thermal expansion coefficient which is different from a thermal expansion coefficient of the first expansion element and being permanently connected to the first expansion element in a region of a free end of the second expansion element, and a spring acting on the second expansion element in an axial direction thereof, wherein the second expansion element acts upon the contact spring from one side, and the spring acts upon the contact spring from another side through intervention of a support.

Through the measures suggested, it is ensured that the contact spring is clamped between the rod and the support that the spring is applied to. The contact spring is brought into its open position, in the event of an appropriate increase of the temperature, by the spring applied to the support. It is therefore possible to elastically pre-tension the contact spring in the cold state of the temperature sensor, the mechanical tension in the contact spring being reduced with increasing temperature. At the same temperature and/or current load, compared with the known solution of the indirect snap mechanism, a significantly reduced tension load of the contact spring results, since the spring supported on the support assumes tasks which the contact spring must assume itself in the known solution. This has a positive effect on the material fatigue.

Since the contact spring is clamped between the support the spring is applied to and the rod, because of the optimized mechanical transmission in the region of the contact spring, advantages also result in regard to elevated stability of the switching behavior, i.e., the switching point precision.

A further advantage of the support is a cooling effect away from the contact spring through the thermal conduction processes. Through the position of the supporting compression spring on the side of the contact spring facing away from the thermal introduction of the sensor tube and internal rod, the temperature load of the spring material is reduced so much by the thermal dissipation of the heat introduced into the compression spring in the direction of the regulator housing and, as a result, the regulator surroundings, that fatigue appearances of the material of this additional spring element are avoided and the stability of the switching point position of the contact spring is ensured through the uniform supporting effect of the compression spring. The contact spring may thus also be subjected to higher strains in regard to the temperature and the electrical load.

The support additionally allows simple manufacturing of two-contact or multi-contact thermostats, for example, for a heating display, while incorporating a plunger as a transmission element that is positioned coaxially to the rod, as an extension thereto. Using an additional transmission element implemented in this way, every axial expansion, no matter how small, is precisely transmitted directly to a second contact system.

According to another feature of the present invention, the spring acting against the rod may be supported on a buttress fixed to the housing and act on the support via a spring plate. Through a buttress fixed to the housing, the spring force may be defined especially well. Without being fixed on a specific embodiment in regard to the material selection, it is nonetheless expedient to manufacture the plunger on which the spring is directly supported from metal and the support from ceramic.

As an alternative, the spring acting against the rod may be supported on a spring plate variant detachably attached to the housing and may act on the support via the spring plate. This spring plate variant, preferably implemented from a metallic material, has essential assembly and processing advantages and enlarges the metallic surface used for thermal dissipation through direct thermal conduction from the spring into the spring plate, through which the temperature loads on the contact spring and the spring are reduced further.

In an implementation of the temperature sensor in which two contact springs are provided, each carrying a contact and implemented as a snap spring, and each is pre-tensioned toward one setting, the second contact spring may be controlled via a plunger, pressed against the support and its side facing away from the rod guided in the tube, which penetrates the contact spring and is connected to a sleeve working together with the second contact spring. Using two contact springs, in which the main contact spring is clamped between the rod guided in the tube and a spring-loaded support, the second contact spring is controlled via a plunger, pressed against the support and its side facing away from the rod guided in the tube, which penetrates the contact spring and is connected to a sleeve working together with the second contact spring. Minimal fatigue and optimal transmission is thus ensured for both contact systems. In a refinement of the present invention, an adjustment spring, which is also supported on the plunger, is supported on a shoulder of the sleeve. Such an adjustment spring makes precise adjustment of the temperature sensor to predefined temperatures easier.

In particular, the support and/or the plunger may be manufactured from electrically non-conductive material, particularly ceramic. An electrical connection between the contact systems may thus be avoided and the safety may thus be elevated.

In an alternative embodiment, the contact spring may have a linear support, the contact spring preferably being implemented as a double wave or as an open wave having a wave bow in the section between the sensor rod and the support. The axial distance from the rod to the support may thus be set exactly.

According to another feature of the present invention, the region of the wave bow may be protected from deformations by an additional fitted metal rod.

As an alternative, the contact spring may have a punctual support, the contact spring preferably having embossed pressure points or an embedded sphere in the section between the sensor rod and support. The contact sphere may be implemented, for example, from non-rusting or hardened metal and/or ceramic.

BRIEF DESCRIPTION OF THE DRAWING

Other features and advantages of the present invention will be more readily apparent upon reading the following description of currently preferred exemplified embodiments of the invention with reference to the accompanying drawing, in which:

FIGS. 6*a*, 7*a*, 7*b*, 8*a*, and 9*a* show sections through different embodiments of the contact spring in the region of the transmission above and below the contact spring, and FIGS. 6*b*, 7*c*, 8*b*, and 9*b* show top views of different embodiments of the contact spring in the region of the transmission.

DETAILED DESCRIPTION OF PREFERRED EMBODIMENTS

Figure 1:
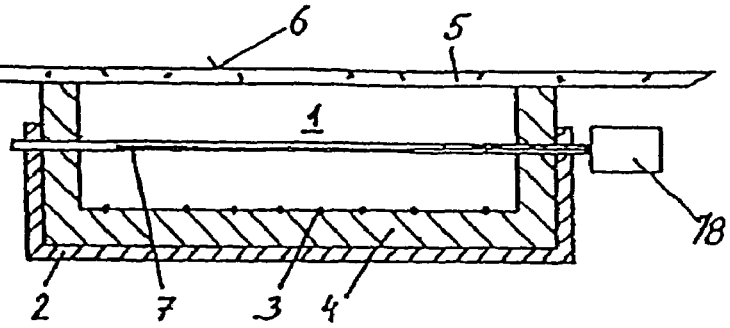
FIG. 1 shows schematically a radiant heating body having a temperature sensor according to the present invention, taken along the line I-I in FIG. 2.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
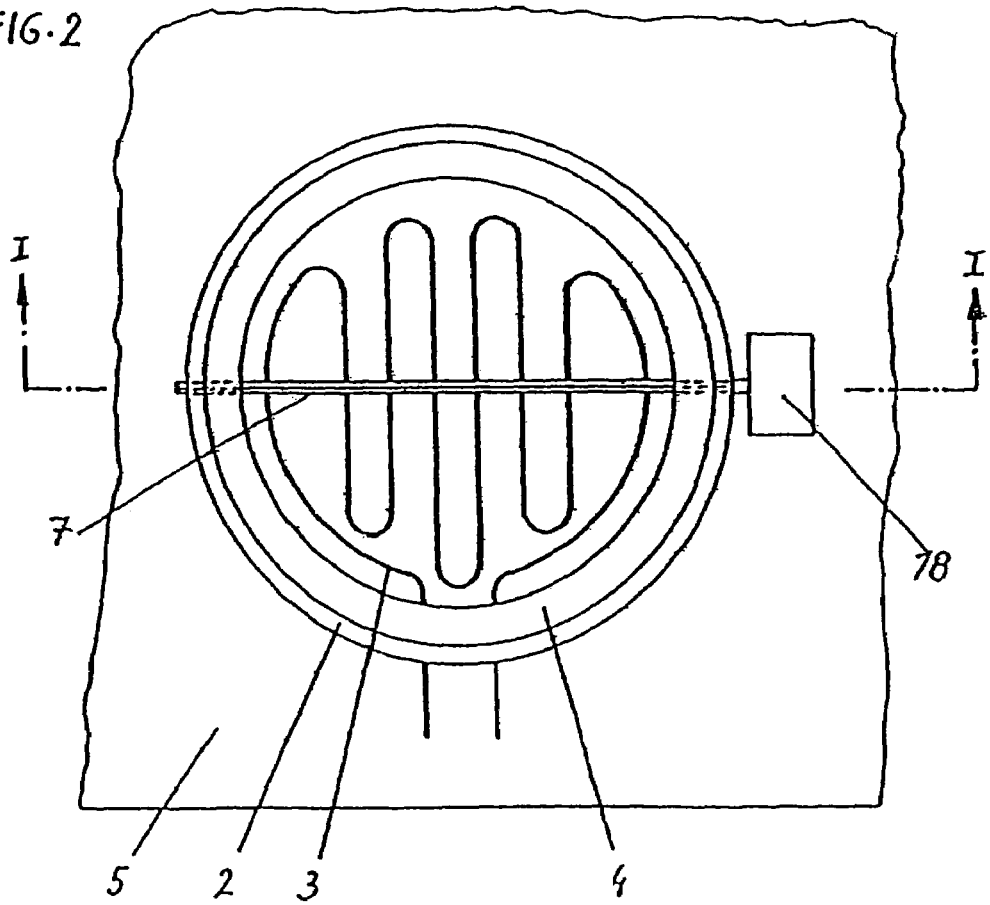
FIG. 2 shows a top view of a radiant heating body having a temperature sensor.

Turning now to the drawing, and in particular to FIG. 1, there is shown a radiant heating element 1 having a trough 2, in which a spiral-laid heating coil 3 is located that is embedded in an embedding compound 4 (see FIGS. 1 and 2). The radiant heating body 1 is positioned below a plate 5 made of metal, glass ceramic, or the like, that forms a cooking area 6. A temperature sensor 7 is positioned between the cooking area 6 and the heating coil 3, which is connected to a breaker head 18, the temperature sensor 7 simply being guided through holes in the housing of the radiant heating body 1.

The temperature sensor 7 is thus subjected to the temperature which exists below the cooking area 6 in the radiant space between the cooking area 6 and heating coil 3 and may thus register this temperature.

Figure 3:
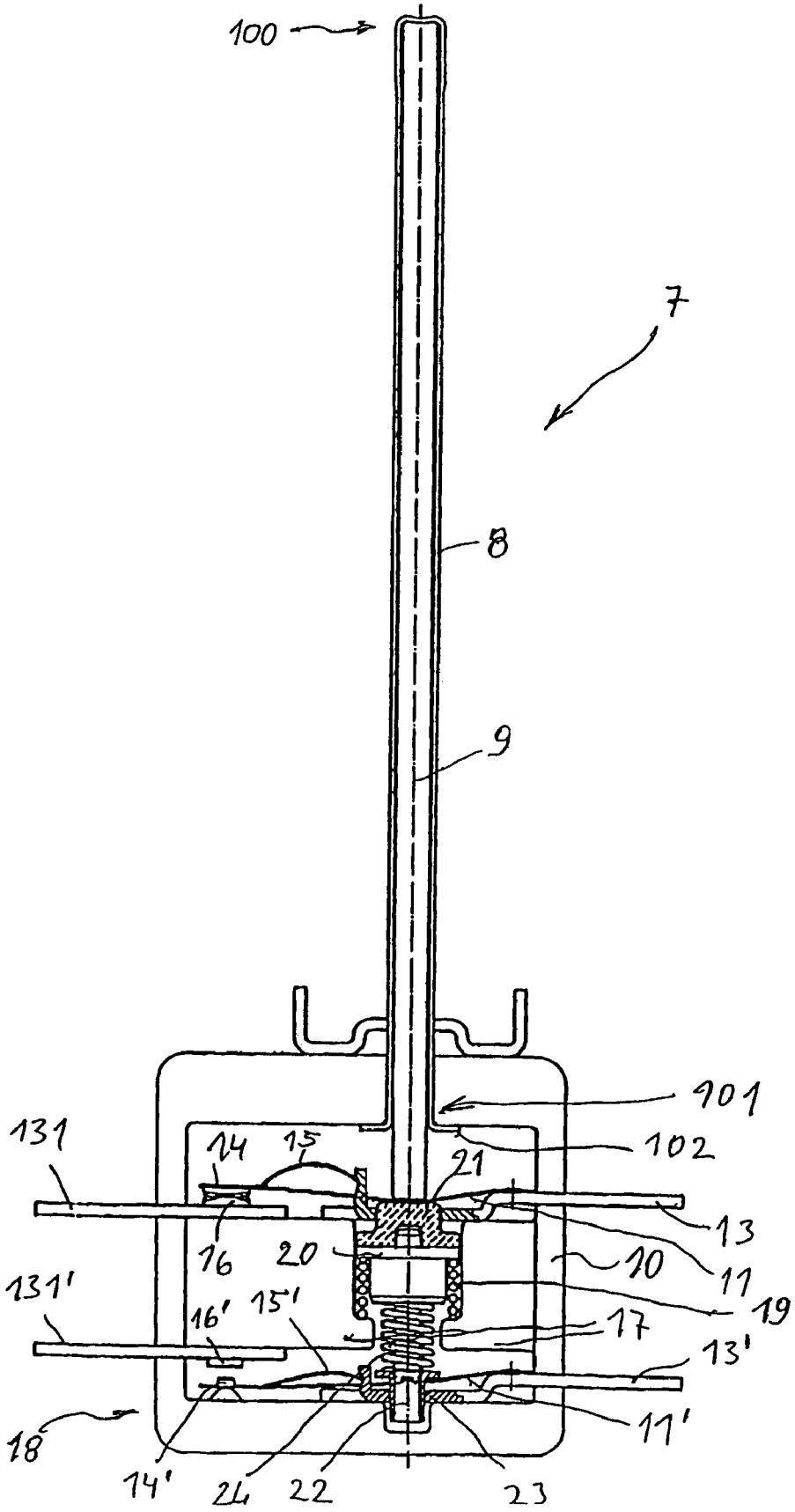
FIG. 3 shows a section through a double-contact temperature sensor according to the present invention.

The construction of this temperature sensor 7 may be seen from FIG. 3.

Two oblong expansion elements 8, 9 are provided, which have differently large material-specific thermal expansion coefficients. These expansion elements 8, 9 may be implemented as bar-shaped and lying next to one another. Preferably, as in the exemplary embodiment shown, the first expansion element 8 is implemented as a tube, particularly having a circular cross-section, and the second expansion element is implemented as a rod 9, which preferably has a circular cross-section and is positioned fitting inside the tube 8.

In the following, for better clarity, the first expansion element is identified as the tube 8 and the second expansion element as the rod 9, the tube 8 having a larger thermal expansion coefficient than the rod 9. The tube 8 may be manufactured from metal having a higher thermal expansion coefficient and the rod 9 may be manufactured from ceramic, glass, or a metal having a lower thermal expansion coefficient.

In the region of the free end 100 of the tube 8, the tube 8 and the rod 9 are held immovably to one another in the axial direction by the support of the rod 9 on the closed end 100 of the tube, while in contrast these two elements 8, 9 are held movably in relation to one another in the axial direction in the second end region of the tube 8.

For adjustment, an adjustment cap 110 is provided on the free end of the rod 9, which is mounted so it is initially displaceable in the direction of the actuation motion of the temperature sensor. The rod 8 is pushed against the contact spring 11 in the cold state using this adjustment cap 110 and fixed in relation to the tube 9 after reaching the adjusted position, this fixing able to be performed through laser welding or gluing, for example. Before the final fixing of the adjustment cap 110, the precision and reproducibility of the adjustment setting may be tested by displacing the adjustment cap 110 multiple times, through measuring the particular switching points and comparing them to one another. Through this displacement procedure and/or snap procedure of the contact spring 11, it is additionally ensured that the flexible tongue 15 is optimally placed in the spring bearing notch.

For exact setting of the opening switching point of the second contact spring 11', the sleeve 23 is now displaced in the direction of the first contact system, which was adjusted as described above, against the force of the spring 19, which is supported on the shoulder of the sleeve 23, until the second contact spring 11' closes. The sleeve 23 is then pushed back by the force of the spring 19 to the contact spring 11' of the second contact system until this contact opens. From this switching point, the sleeve travels further on the calculated differential path in accordance with the desired switching temperature difference to the current room temperature. Upon reaching the desired differential path, the sleeve 23 is permanently connected to the plunger 22 by laser welding and a defined opening switching point position of the second contact system is thus ensured.

The one end 101 of the tube 8 is fixed in a housing end of a breaker head 18, the tube 8 being provided with a flange 102 which presses against the inside of the housing 10. Terminals 13, 13', 131, 131' are positioned in the breaker head 18 and/or its housing 10, contact springs 11, 11' being attached in an electrically conductive way to the terminals 13, 13' inside the housing 10, e.g., riveted thereto. These contact springs 11, 11' are implemented as snap springs and carry contacts 14, 14'.

Flexible tongues 15, 15' are bent out of the contact springs 11, 11', which are supported on bent-out ends of the terminals 13, 13' in spring bearing notches, for example, and ensure snapping behavior of the contact springs 11, 11'.

The terminals 131, 131' carry fixed contacts 16, 16' which work together with the movable contacts 14, 14' of the contact springs 11, 11'.

A buttress 17, which is fixed in the housing and on which a spring 19 is supported, is positioned inside the housing 10 of the breaker head 18. This spring 19 acts on a support 21 via a spring plate 20. In this case, the contact spring 11 is clamped between the rod 9 and a support 21.

The support 21 is also implemented as cap-shaped and receives the plunger 22 in a depression facing away from the contact spring 11 and therefore also from the rod 9. This plunger 22 is permanently connected to the sleeve 23, which has a flange. In this case, the sleeve 23 and the plunger 22 penetrate the contact spring 11' and the terminal 13'.

The plunger 22 is enclosed by an adjustment spring 24 which is supported on the flange of the sleeve 23 and the spring plate 20.

If the tube-rod system 8, 9 is subjected to increasing temperature, the tube 8 expands more strongly than the rod 9, because of which the penetration depth of the rod 9 into the housing 10 is reduced and the contact spring 11 is pressed upward by the spring-loaded support 21. As soon as the contact spring 11, whose intrinsic tension is reduced at the same time, is pressed a specific amount upward, it snaps over and the contacts 16, 14 are disconnected and therefore the path of the current from the terminal 13 to the terminal 131 is interrupted.

However, the plunger 22 simultaneously also travels upward, due to which the sleeve 23 also travels upward and its flange also allows the contact spring 11' to travel upward in accordance with its pre-tension and this snaps over and its contact 14' comes into contact with the fixed contact 16' and the corresponding path of the current from the terminal 13' to the terminal 131' is closed.

In this case, in operation the path of the current from the terminal 13' to the terminal 131' is closed first and the path of the current from the terminal 13 to the terminal 131 is only opened at a higher temperature.

The reversed procedure results if the temperature is reduced.

Through the adjustment procedure, the contact spring 11 is pre-tensioned between the rod 9 and the support 21, the setting corresponding to the cold state of the temperature sensor. With increasing temperature, the plunger and therefore the contact spring travel outward, and the mechanical strain of the contact spring 11 is reduced. Simultaneously, it is ensured through the spring 19 that the support 21 is pressed against the contact spring 11 and therefore heat is conducted away from the contact spring 11.

Figure 4:
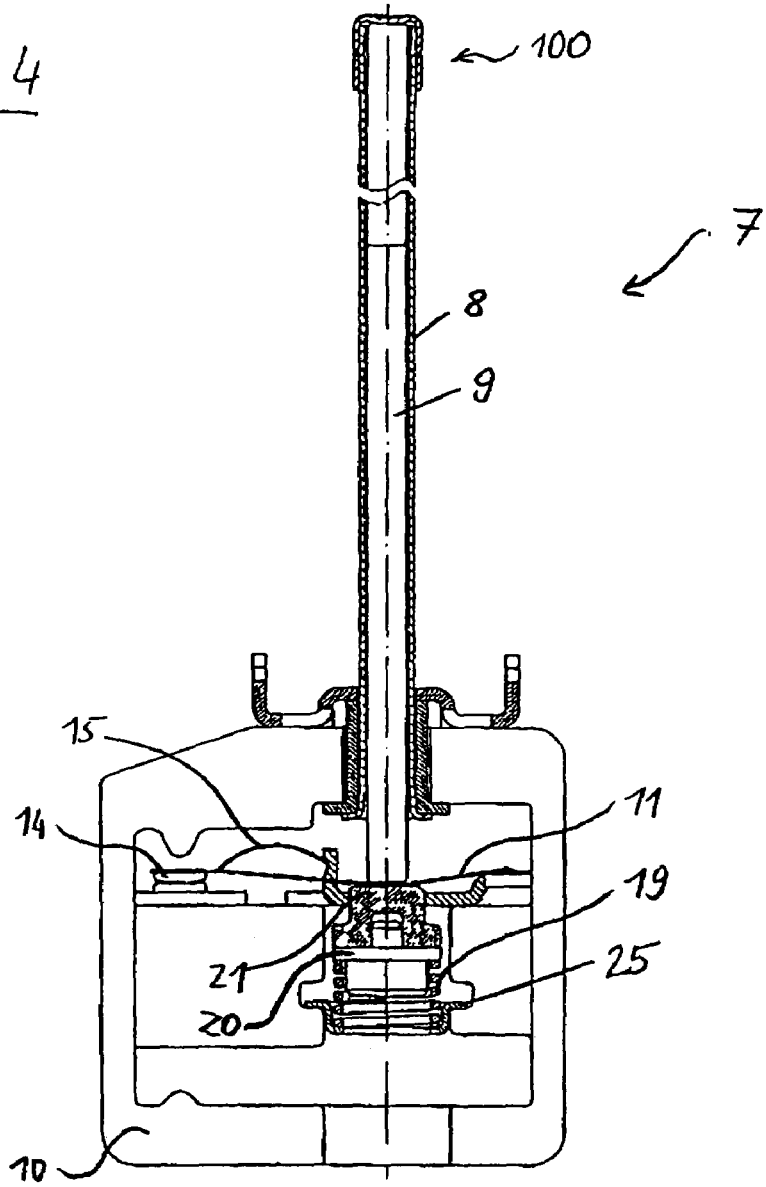
FIG. 4 shows a section through a single-contact temperature sensor according to the present invention.
Figure 5:
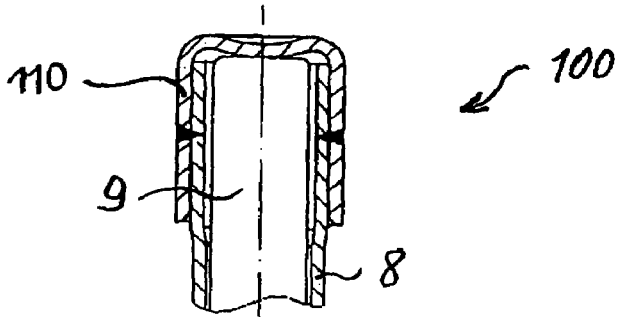
FIG. 5 shows a section through the end of the sensor rod system.

In the case of a single-contact system in particular (see FIG. 4), the spring 19 acting against the rod 9 is supported on a spring plate variant 25, which is not fixed to the housing, and acts on the support 21 via a spring plate 20.

A critical point for switching point precision, both of the main thermal contact system and of the second contact system, e.g., for a heating display, is represented by the mechanical transmission of the rod 9 to the contact spring 11 and the support 21. Generally, this is achieved through the wavy implementation of the contact spring 11. A linear or punctual support between rod 9 and contact spring 11 and/or contact spring 11 and support 21 and therefore a high switching point precision is thus achieved, the punctual support not having a negative influence on the adjustment even if the rod 9 tilts. Since the contact spring 11 is clamped between the support 21 pre-tensioned by the spring 19 and the rod 9, the transmission must occur above and below the contact spring. Special embodiments for this purpose are illustrated in FIGS. 6 through 9. A punctual support may also be achieved through an embedded sphere 28 or by pressure points 27. Linear transmission may be achieved through a double-wave shape of the contact spring 11 (see FIGS. 8*a*, *b*) or implementation as an open wave (see FIGS. 7*a* through *c*), a fitted metal rod 26 also able to be introduced in the latter case, which protects the region of the wave bow (29) from deformation.

For a single-contact regulator, it is possible in a preferred embodiment to use one single part made of ceramic or metal for the functions of the plunger 22 and the support 21.

The second contact spring is typically used solely for controlling a signal device, also referred to as a heating display, e.g., a signal light to display that the radiant heating element 1 and/or the cooking area 6 exceeds a temperature of 65° C., for example.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A temperature sensor for a radiant heating element, comprising:

a switch having a housing and at least one contact spring which carries a contact and is implemented as a snap spring;

a first expansion element connected to the housing of the switch;

a second expansion element having a thermal expansion coefficient which is different from a thermal expansion coefficient of the first expansion element and being permanently connected to the first expansion element in a region of a free end of the second expansion element; and a spring acting on the second expansion element in an axial direction thereof, wherein the second expansion element acts upon the contact spring from one side, and the spring acts upon the contact spring from another side through intervention of a spring-loaded support, wherein the contact spring is pre-tensioned between the second expansion element and the support, when the temperature sensor is in a cold state, and wherein the support and the second expansion element interact with the contact spring such that a mechanical strain on the contact spring decreases with an increase in temperature.

2. The temperature sensor of claim 1, wherein the first expansion element is a tube.

3. The temperature sensor of claim 1, wherein the second expansion element is a rod.

4. The temperature sensor of claim 1, wherein the switch includes a buttress fixed to the housing, said spring being supported on the buttress and acting on the support via a plate spring.

5. The temperature sensor of claim 1, wherein the switch includes a spring plate detachably secured to the housing, said spring being supported on the spring plate and acting on the support via the spring plate.

6. The temperature sensor of claim 1, and further comprising a second said contact spring, wherein the second contact spring is controlled via a plunger which rests against the support at a side facing away from the second expansion element which is guided in the first expansion element, said plunger extending through the spring and connected to a sleeve which interacts with the second contact spring.

7. The temperature sensor of claim 6, and further comprising an adjustment spring supported on the plunger and supported on a shoulder of the sleeve.

8. The temperature sensor of claim 6, wherein at least one member selected from the group consisting of support and plunger is made of electrically non-conductive material.

9. The temperature sensor of claim 8, wherein the member is made of ceramic.

10. The temperature sensor of claim 6, wherein the contact spring has a linear support and is constructed in an area between the second expansion element and the support in the form of a double-wave shape.

11. The temperature sensor of claim 6, wherein the contact spring has a linear support and is constructed in a section between the second expansion element and the support in the form of an open wave having a wave bow.

12. The temperature sensor of claim 11, and further comprising an additional filled metal rod in a region of the wave bow for protecting the wave bow from deformation.

13. The temperature sensor of claim 1, wherein the contact spring has a punctual support is provided in a section between the second expansion element and the support with embossed pressure points.

14. The temperature sensor of claim 1, wherein the contact spring has a punctual support is provided in a section between the second expansion element and the support with an embedded sphere.

* * * * *